US005182895A

United States Patent [19]

Lugo

[11] Patent Number: 5,182,895

[45] Date of Patent: Feb. 2, 1993

[54] SHOPPING BAG SYSTEM AND METHOD

[76] Inventor: Nicolas R. Lugo, 1521 Bellevue Ave. #105, Seattle, Wash. 98122

[21] Appl. No.: 863,593

[22] Filed: Apr. 2, 1992

[51] Int. Cl.[5] ..... B65D 25/14; B65D 30/00; B60R 11/00; B65B 61/14

[52] U.S. Cl. ..... 53/469; 53/473; 53/507; 206/459.5; 206/554; 224/277

[58] Field of Search ..... 53/473, 475, 468, 469, 53/480, 413, 507; 383/37, 86; 224/277, 273; 206/554, 459.5

[56] References Cited

U.S. PATENT DOCUMENTS

| | | | |
|---|---|---|---|
| 2,038,952 | 4/1934 | Niedorr et al. | 150/1.7 |
| 2,473,429 | 6/1949 | Hinman | 224/45 |
| 2,671,486 | 3/1954 | Shaw | 150/1.7 |
| 3,306,437 | 2/1967 | Nelson | 206/459.5 |
| 4,117,874 | 10/1978 | Berenguer | 150/1.7 |
| 4,154,383 | 5/1979 | Honatzis | 206/554 X |
| 4,542,826 | 9/1985 | Adams | 206/427 |
| 4,708,243 | 11/1987 | Nailon | 206/554 X |
| 4,782,874 | 11/1988 | Chartier | 150/112 |
| 4,966,318 | 10/1990 | Dutka | 383/86 X |
| 5,012,966 | 5/1991 | Turner et al. | 206/804 X |
| 5,046,860 | 9/1991 | Brennan | 383/38 |

*Primary Examiner*—James F. Coan
*Attorney, Agent, or Firm*—Dean A. Craine

[57] ABSTRACT

A system and method for shopping are described which includes a lightweight, compact carrier, made of nylon or fabric material, designed to carry a set of reusable shopping bags. The set of shopping bags comprise a plurality of bag structures made of either nylon, fabric or paper material. The bag structures are folded into a compact shape which are then placed on one edge and stacked horizontally in a side by side manner inside the carrier. The entire bottom surface or a band having an identifying color is printed on the bottom surface of each bag structure which identifies the size of the bag structure. During use, the bag structures are folded and stacked inside the carrier so that a portion of the colored bottom surface or colored band on each bag structure is visual when each bag structure is stored inside the carrier which enables the user to identify and select the correct bag structure from the set of shopping bags. Optional colored coded elements may be printed on the outside surface of the front and rear surfaces of the carrier help the user or his assist select the correct bag structure. The lid panel of the carrier may be folded back over and attached to the back side of the carrier to attach the carrier to a shopping cart.

20 Claims, 6 Drawing Sheets

SHOPPING BAG SYSTEM AND METHOD

BACKGROUND OF THE INVENTION

1. Field of the Invention

This invention relates to systems and methods for carrying shopping items.

2. Description of the Related Art

In the United States, it is common practice for store owners to supply paper or plastic shopping bags for their customers. In spite of the detrimental effects these bags may have on the environment, there does not appear to be any movement in the United States to encourage or to require shoppers to use either recyclable or reusable shopping bags. This is in sharp contrast with the practices in many foreign countries where shopping bags are not supplied to customers by store owners.

In the United States, there are several different types and sizes of shopping bags available to shoppers. In the grocery industry, for example, both plastic shopping bags or paper shopping are generally available throughout the United States.

There are several reasons postulated on why shopping bags are not recycled or reused in the United States. Some reasons cited are based on economics and politics factors. Other reasons cited are based on the unique shopping practices in the United States and not found in many foreign countries. In the United States, it is common practice for families to go shopping for food once or twice weekly. During these trips, large quantities of food and other items are usually purchased and brought home in several large shopping bags. This is in sharp contrast with the shopping practice found in many foreign countries where shoppers typically go shopping for food daily. Since more frequent trips are made to the store each week, fewer items are purchased during each trip compared to the number of items purchased each trip by shoppers in the United States. As a result, foreign shoppers carried home fewer, small shopping bags than shoppers in the United States. The number and size of recyclable or reusable shopping bags which foreign shoppers must bring to the store is not a substantial burden or inconvenience.

A shopping system and method designed for shoppers in the United States to encourage them to use reusable shopping bags is needed. In Brennan, (U.S. Pat. No. 5,046,860), a shopping bag assembly is disclosed which includes a primary bag and a plurality of auxiliary bags stored and carried inside the primary bag. The shopping bag assembly, however, is not convenient to carry and has several additional drawbacks which will be apparent from the disclosure of the invention described herein.

SUMMARY OF THE INVENTION

It is an object of the invention to provide a shopping bag system which encourages shoppers to use reusable shopping bags.

It is another object of the invention to provide such a system specifically designed for shoppers in the United States and other countries with similar shopping practices.

It is another object of the invention to provide a method of shopping using reusable shopping bags.

The shopping bag system and method described herein are designed to encourage shoppers to use or recycle shopping bags and thereby, save the environment. Since shoppers in the United States represent the largest group of shoppers which do not currently use reusable shopping bags, the system and method described herein are designed for shoppers in the United States.

The shopping bag system comprises a lightweight, compact carrier designed to conveniently hold a set of shopping bag structures. The system includes a compact carrier, which is made of durable fabric or nylon material. The carrier is sufficiently compact so that it may be easily be transported in a handbag or purse. A strap may be attached to the carrier to enable the user to conveniently carry around the shoulder or neck. Also, a cart attachment means may be attached to the carrier which enables the user to attach the carrier to the side of the shopping cart while shopping. The carrier is designed to hold a set of folded bag structures generally required during a typical grocery shopping trip. In one embodiment, the set of bag structures, made of either nylon or paper material, include four large size shopping bags, three medium size shopping bags, and two small size shopping bags. In another embodiment, designed for other types of shopping trips, the set of bag structures include six, large paper shopping bags. In each embodiment, each shopping bag has plurality of creases or fold lines manufactured thereon which enable the user to manually folded them into a compact shape for storage inside the carrier. In addition, each shopping bag has a size identification means printed thereon which enables the user to proper identify and select the correct size of bag structure from the system.

During use each bag structure is folded and placed inside the carrier so that the size identification means printed on each bag structure may be seen by the user while stored inside the carrier.

An optional cart attachment means is attached to the carrier which enables the user to attach the carrier to the side of a typical shopping cart while shopping. This allows the user or shopping clerk to easily and conveniently select a bag structure from the carrier. A bag size indicator may be printed on the outside surface of the carrier to help the user or clerk select the correct size of bag structure from the carrier.

Using the above described system, a method of shopping using is also provided.

DESCRIPTION OF THE PREFERRED EMBODIMENT(S)

Figure 1:
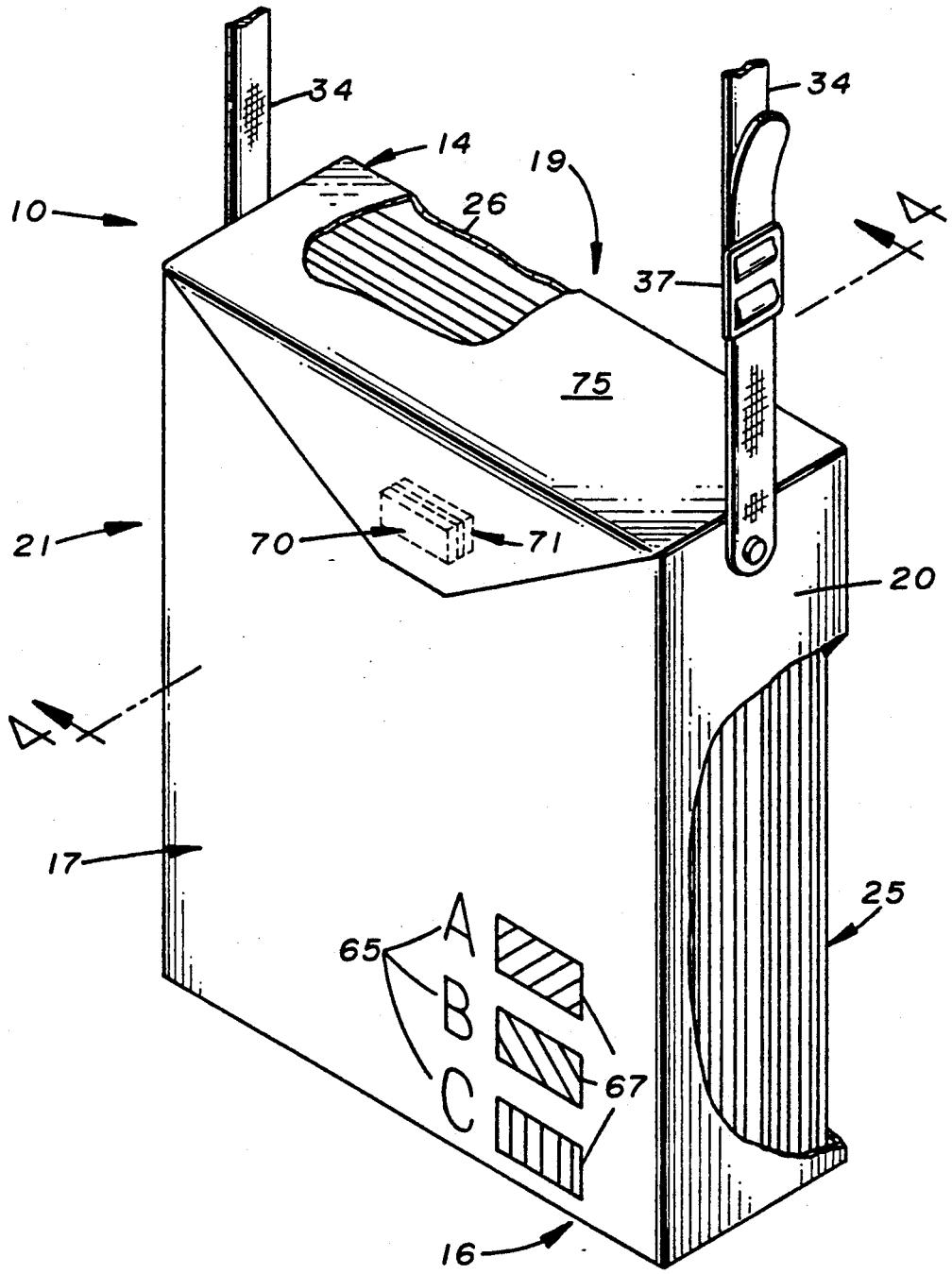
FIG. 1 is a perspective view of shopping bag system described herein.

Shown in the accompanying FIGS. 1-11, there is shown a shopping bag system, generally referred to as 10, designed to encourage shoppers to use reusable or recyclable shopping bags. The system 10 comprises a carrier 14 which conveniently carries and stores a set of shopping bags 25. The set of shopping bags 25 comprises a plurality of bag structures, generally referred as 26, which are manually folded into a compact shape and placed inside the carrier 14. By folding each bag structure 26 into a compact shape, the size of the carrier 14 needed to carry and store the bag structures 26 is substantially reduced.

As shown more particularly in FIGS. 1-4, the carrier 14 is a narrow, rectangular structure made of lightweight durable material, such as cotton fabric or nylon material. The carrier 14 has a reinforced, planar bottom panel 16, a planar front panel 17, a planar back panel 19, a planar right side panel 20, and a planar left side panel 21. The side edges of the front panel 17 and back panel 19 are sewn or adhesively attached to the adjoining edges of the right side panel 20 and left side panel 21. The bottom edges of the front panel 17 and back panel 19 are sewn or adhesively attached to the adjoining edges of the bottom panel 16. A lid panel 75 is integrally attached to the back panel 19 and used to selectively open or close the carrier 14. By pivoting the lid panel 75, around the adjoining edge, the user may be open the carrier 14 to gain access to the storage space 24 located therein.

To close the carrier 14, the lid panel 75 is pivoted downward over the front panel 17. An optional closure means may be disposed between the inside surface 76 of lid panel 75 and the outer surface 18 of front panel 17 to securely hold the lid panel 75 in a closed position on the carrier 14. In one embodiment, the closure means comprises a pad 70 made of hook material attached horizontally along the inside surface 76 of the lid panel 75 and a pad 71 made of loop material attached horizontal directly across from the pad 70 on the outer surface 18 of the front panel 17. To securely close the lid panel 75, the pads 70 and 71 are interconnected. For other embodiments, other types of closure means may be provided.

During use, the plurality of bag structures 26 are folded and positioned inside the carrier 14. In order to fit inside the carrier 14, the carrier 14 must be manufactured a sufficient size so that all of the folded bags structures 26 in the set 25 may be placed therein. In the preferred embodiment shown in FIGS. 1-4, the system 10, the set of shopping bags 25 comprises nine separate bag structures 26 made up of four large bag structures 26*a*, three medium bag structures 26*b*, and two small bag structures 26*c*. This combination of bag structures 26, which is designed for shoppers in the United States, gives a shopper a wide variety of different size bag structures. It should be appreciated, however, that other sets of shopping bags comprising different combinations of bag structures 26 may be used with the carrier 14.

Figure 5:
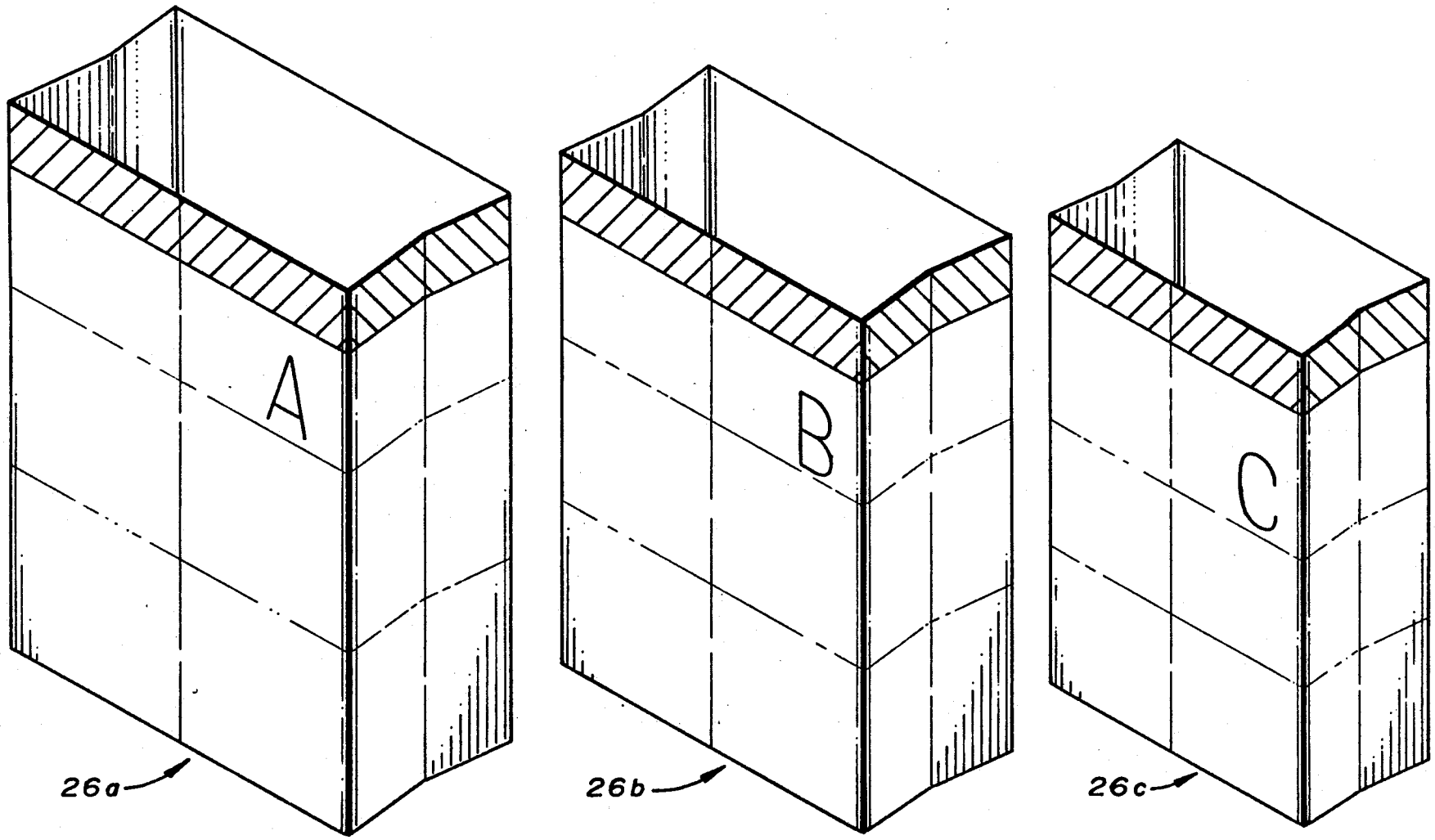
FIG. 5 is a perspective of three different bag structures that comprise the first set of shopping bags.
Figure 6:
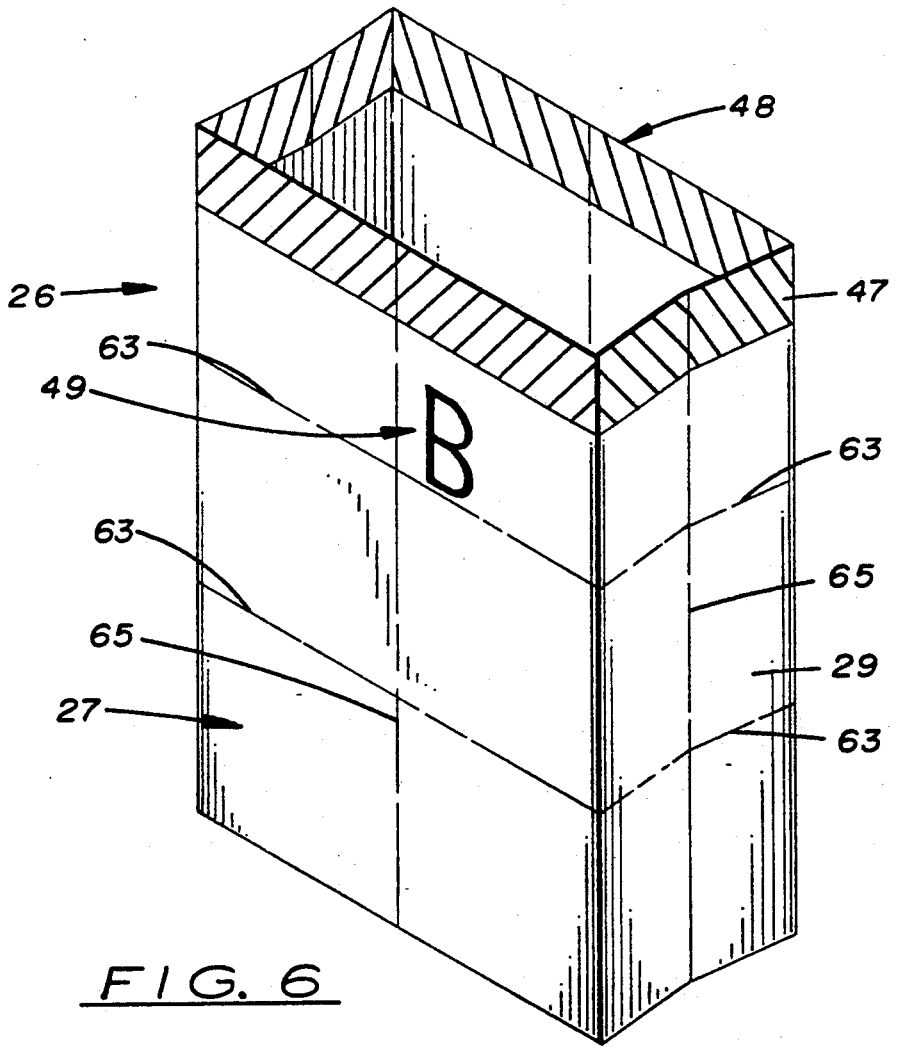
FIG. 6 is a perspective view of a bag structure.

The three bag structures 26*a*, 26*b*, and 26*c*, shown in FIG. 5, are approximately the same size as 62½ lbs., 35 lbs., and 25 lbs. paper shopping bags, respectively, used today in many grocery stores in the United States. Most shoppers and store workers are accustomed to using such bag sizes. This will increase adoption and use of the system 10. In addition, by making the bag structures 26 similar in size to existing paper bags, shoppers are able to substitute existing paper bags with the bag structures 26 described in the system 10.

In the preferred embodiment, the bag structures 26 are made of durable nylon material. It should be understood, however, the bag structures 26 could be made of fabric or paper material. Each bag structure 26 has a front surface 27, a back surface 28, a right side surface 29, a left side surface 30, and a reinforced bottom surface 31. The large bag structures 26*a* measure approximately 12 inches (L)×7 inches (W)×17 inches (H). The medium bag structures 26*b* measure approximately 10 inches (L)×6 inches (W)×16 inches (H), and the small bag structures 26*c* measure approximately 8 inches (L)×5 inches (W)×16 inches (H).

A size identification means is printed on the bottom surface 31 of each bag structure 26 which enables the user to select the correct size bag structure 26 from the carrier 14. When the bag structures 26 are stored inside the carrier 14, they are folded into a compact shape and placed on one edge inside the carrier 14. When stored in this position, the size identification means printed or manufactured on each bag structure 26 is visible through the opening of the carrier 14. Each size identification means has a distinguishable color which is associated with a particular size of bag structure 26. During use, the shopper is able to select the correct size of bag structure 26 by recognizing the color of the size identification means printed on the bag structure 26.

Figure 7:
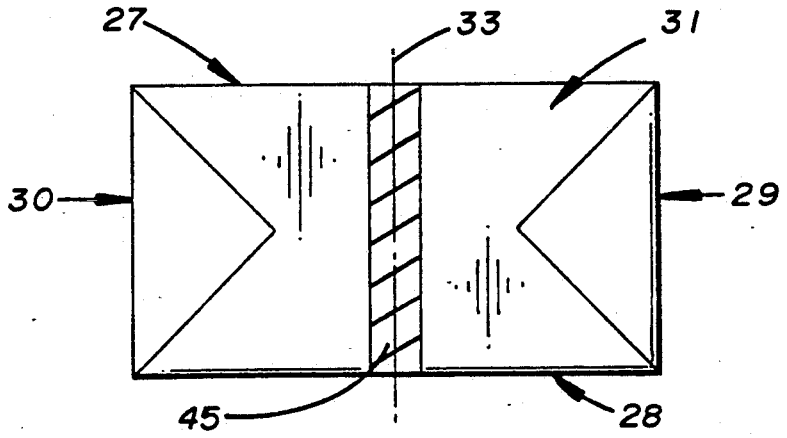
FIG. 7 is a bottom plan view of the bag structure shown in FIG. 6.

In the embodiment shown in FIG. 7, the size identification means comprises a colored stripe 45 printed across the bottom surface 31 along the transverse axis 33 of bag structure 26. In another embodiment (not show), the size identification means comprises the entire bottom surface 31 printed the specific color. With each embodiment, the colored stripe 45 or colored bottom surface 31, must be a distinguishable color. In addition, each bag structure 26 may have also have a colored band 47 printed around the upper edge 48. An identifying letter 49 or number (not shown) may also be printed on the front and back surfaces 27 and 28, respectively, to help color-blinded individuals identify and select the correct bag structure 26.

As mentioned above, each bag structure 26 must be folded into a compact shape for storage inside the carrier 14. The folded size and shape of he compact shape is important in order for the bag structure 26 to fit inside the carrier 14. The method used to fold the bag structure 26 is also important so that the size indentification means printed on each bag structure 26 is visible when the bag structure 26 is stored inside the carrier 14.

Figures 8A, 8B, 8C, 8D, 8E, 8F:
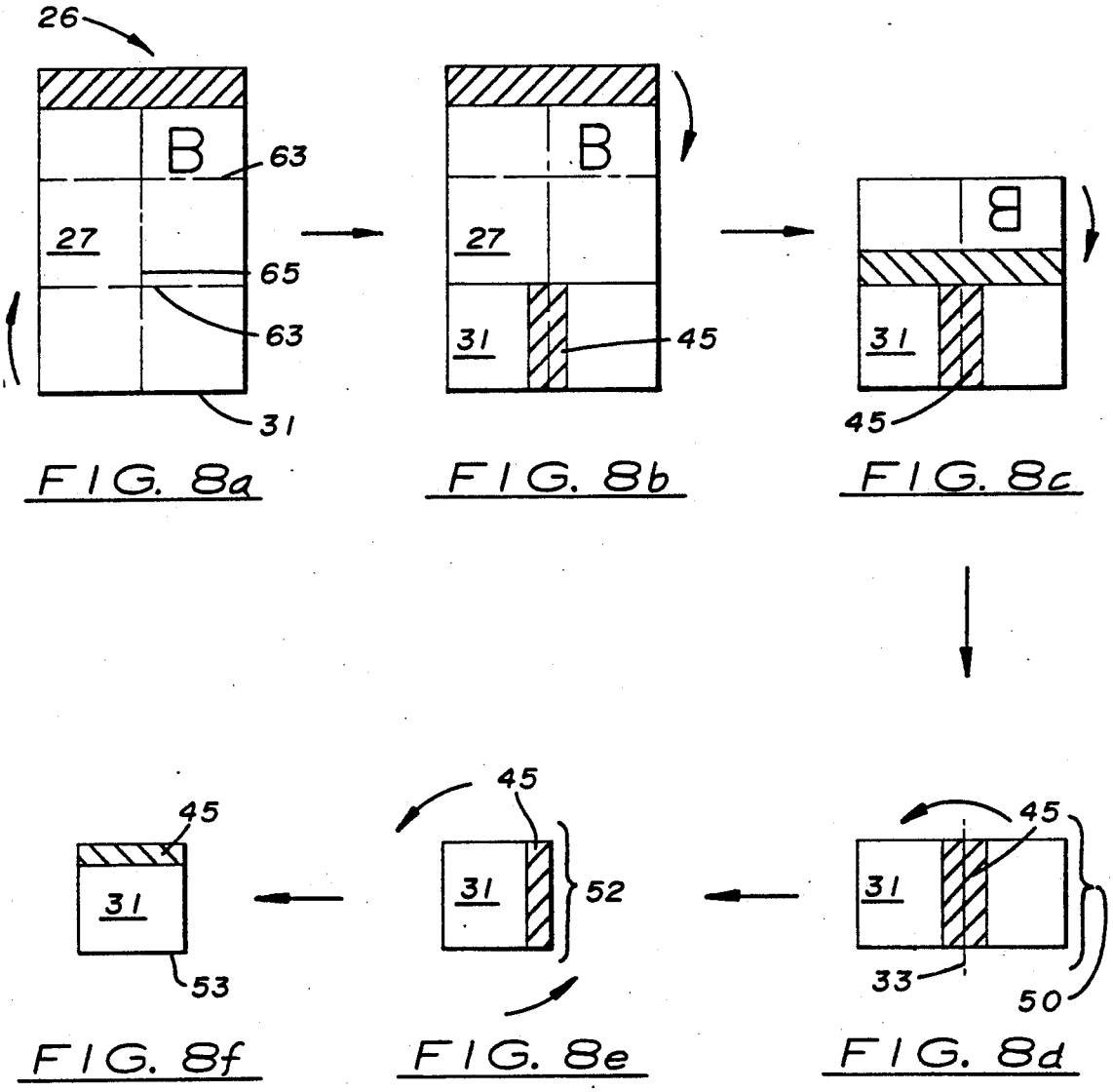
FIGS. 8(*a*)-(*f*) are a series of elevation views showing how each bag structure is folded into a compact shape to fit inside the carrier.

FIGS. 8(*a*)-(*b*) depict how each bag structure 26 is folded into a compact shape. In FIG. 8(*a*), the bag structure 26 is first held vertically with the bag opening extended upward. The bottom surface 31 is folded upward over the lower section of the bag structure 26 and becomes visible when viewed from the side. As shown in FIG. 8(*b*), the top section of the bag structure 26 is folded downward over the middle section of the bag structure 26. As shown in FIG. 8(*c*), the top and middle sections are then folded downward over the bottom section of the bag structure 26 to form a rectangular, one-third section shape 50. Shape 50, shown in FIG. 8(*d*), is then folded in half along the transverse axis 33 to form a square, one sixth section shape 52, shown in FIG. 8(*e*). After the square, one sixth section shape 52 is formed, it is rotated so that the edge formed after folding along the transverse axis 33 positioned on top and the lower edge 53 of shape 52 are oriented in a horizontal position.

Once the square, one sixth section 52 is formed and properly oriented, it can then be aligned vertically and placed on edge 53 inside carrier 14. When placed in the carrier 14 in this matter, the edge along transverse axis 33 is visible when viewed from the top. After the first bag structure 26 is folded and placed inside the carrier 14, the remaining bag structures 26 in the set of shopping bags 25 are folded in the same manner and placed inside the carrier 14.

The bag structures 26 may be made out of nylon, fabric, or paper material. Depending upon the thickness of the materials used, the bag structures 26 may have different folding characteristics. To facilitate proper folding of the bag structures 26, a plurality of fold lines, shown in FIGS. 6 and 8(*a*)–(*e*), may be manufactured or printed on each bag structure 26. In the preferred embodiment, the fold lines comprise two horizontal fold lines 63 and one vertical fold line 65. The horizontal fold lines 63 are located on the front, back, and side surfaces, 27, 28, 29, 30, respectively, of each bag structure 26 which enables it to be folded into three equal sections: an upper section, a middle section, and a lower section. A vertical fold line 65 is located the front 27 and back 28 surfaces of the bag structure 26 which enables it to be folded into two equal left and right sections.

Figure 2:
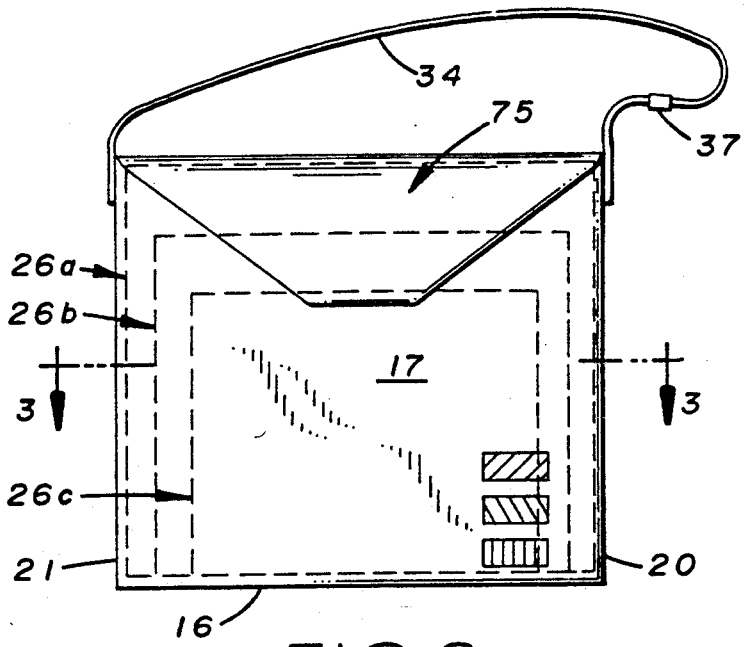
FIG. 2 is a side elevation view of the shopping bag system described herein.
Figure 3:
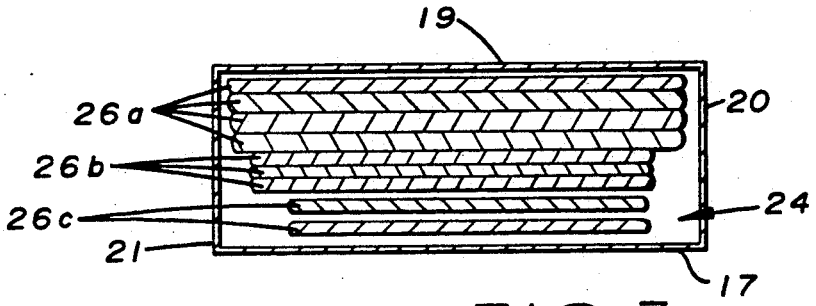
FIG. 3 is a sectional, plan view of the shopping bag system taken along line 3—3 in FIG. 2.
Figure 4:
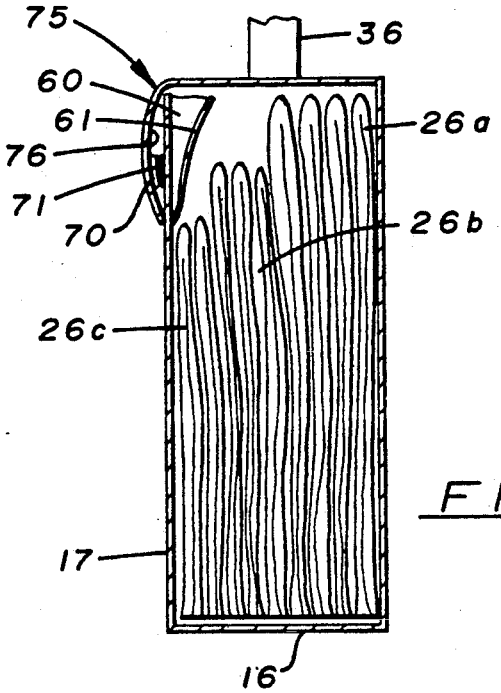
FIG. 4 is a sectional, elevation view of the shopping bag system taken along line 4—4 in FIG. 1.

As shown in FIGS. 2–4, when the large bag structures 26*a* are folded, they form compact shapes measuring approximately 7 inches (L)×¼ inches (W)×6 inches (H). When the medium bag structures 26*b* are folded, they form compact shapes measuring approximately 6 inches (L)×3/16 inch (W)×4 ¾ inches (H). When the small bag structures 26*c* are folded, they produce compact shapes measuring approximately 5 inches (L) ×3/16 inches (W)×4 inches (H). The number and size of bag structures 26 used in the set of shopping bags 25 with the system 10 depends upon the size of carrier 14, the size of the bag structures 26, and the material used to manufacture the bag structures 26.

As shown in FIGS. 1 and 4, a strap 34 may be attached to the carrier 14 which enables the user to carry the carrier 14 on his or her shoulder. One end of the strap 34 is attached to the right side panel 20 while the second opposite end is attached to the left side panel 21 of the carrier 14. The strap 34 has a sufficient length so that it may be placed over the user's shoulder during use. A strap length adjustment means, such as a buckle 37, may be attached to the strap 34 which enables the user to adjust the length of the strap. As shown in FIG. 4, the carrier 14 may also include a strap storage compartment 60 designed to house the strap 34 when not used. In the one embodiment, the compartment 60 is manufactured inside the carrier 14 along the inner surface of front panel 17 just below the opening into the carrier 14. In other embodiments, not shown, the strap compartment may be manufactured on the outside of the carrier 14. The compartment 60 is formed by attaching a strip 61 of fabric material horizontally across the inner surface of front panel 17. The vertical edges of the strip 61 is attached to the inner surfaces of the right and left side panels 20 and 21, respectively.

The size of the carrier 14 must be sufficient to hold the largest folded shape 52 used in the set of shopping bags 25. For example, when the set of shopping bags 25 described above is used, the carrier 14 measures approximate 7¼ inches (L)×2¼ inches (W) and 6½ inches (H). For other sets of shopping bags 25, the carrier 14 may be manufactured in different sizes.

As shown in FIGS. 1–2, an optional bag size code indicator may be manufactured on the front 17 or back 19 panel of the carrier 14 to help the user select the correct bag structure from the carrier 14. In the preferred embodiment, the bag size code indicator are large letters 65 or numbers (not shown) printed on the outer surfaces of panel 17 or 19. The letters or numbers are printed correspond with the letters 49 or numbers printed on the bag structures 26 stored inside the carrier 14. Colored bands 67, having the same colors as the size identification means printed on each bag structure 26, may also be printed on outer surfaces of panels 17 and 19 to aid the user in identifying the correct bag structure 26.

Figure 9:
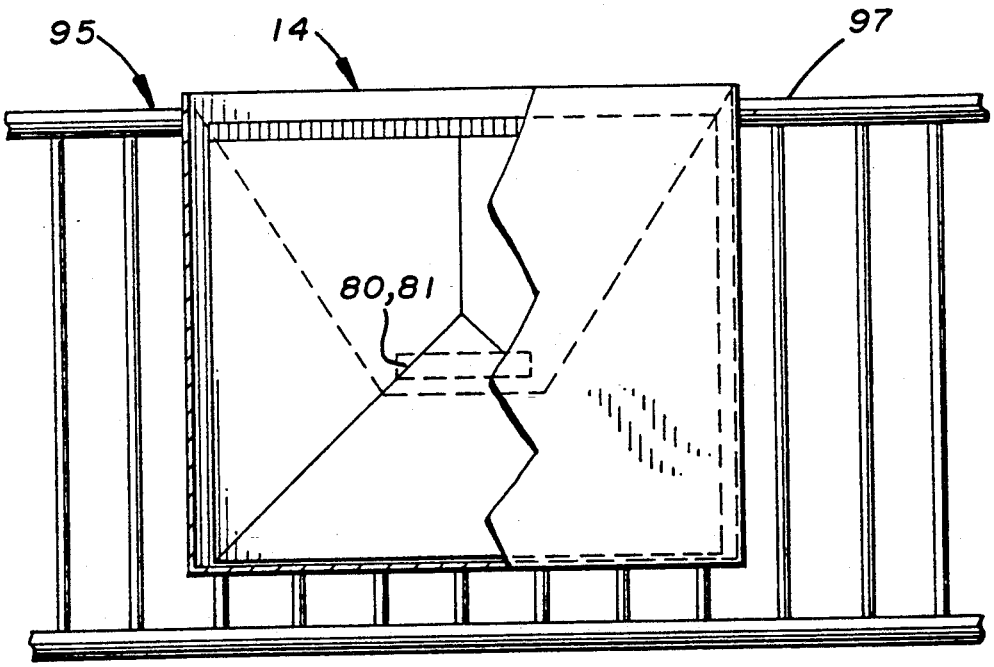
FIG. 9 is a sectional, side elevational of the carrier attached to a shopping cart.
Figure 10:
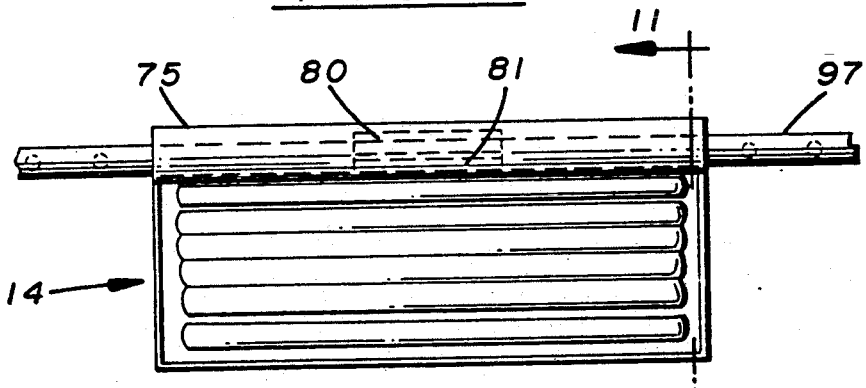
FIG. 10 is a plan view of the carrier attached to the shopping cart.
Figure 11:
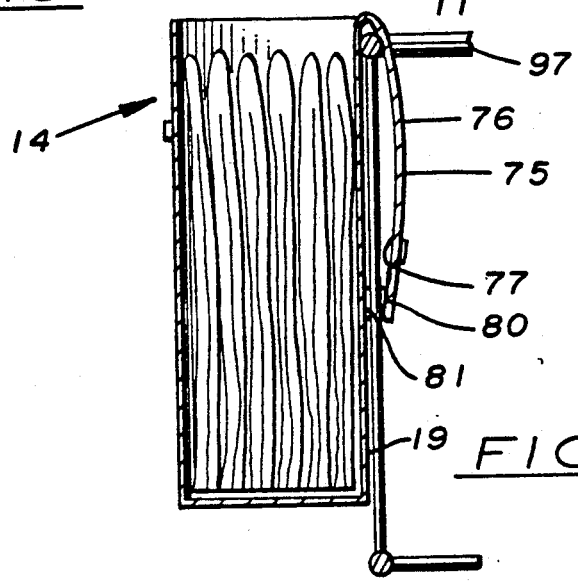
FIG. 11 is a sectional view taken along line 11—11 in FIG. 10.

As shown in FIGS. 9–11, an optional cart attachment means may be attached to the carrier 14 which enables it to be attached to typical shopping cart 95. The cart attachment means includes a pad 80 made of hook material attached horizontally to the outside surface 77 of the lid panel 75 and a pad 82 made of loop material attached horizontally on the outer surface of the back panel 19 of the carrier 14. During use, the carrier 14 is placed adjacent to the top rail 97 on a shopping cart 95. While held in this position, the lid panel 75 is folded rearward over the top rail 97. Pads 80 and 82 are interconnected to selectively hold the lid panel 75 in place around the top rail 97 and to hold the carrier 14 on the shopping cart 95.

Using the above described system 10, a novel method for carrying shopping items is provided. The method comprises the following steps:

1. selecting a carrier 14 carrying a set of shopping bags, the set of shopping bags 25 comprising a plurality of folded bag structures 26 stacked on edge horizontally therein, each bag structure 26 has size identification means printed thereon which is visible when the bag structures 26 are stacked inside the carrier 14, the carrier 14 has an attached cart attachment means which enables it to be selectively attached to a shopping cart 95 when shopping;

2. selecting one bag structure 26 from the set of shopping bags 25 carried inside the carrier 14 using the size identification code printed on each bag structure 26 for carrying shopping items;

3. filling the selected bag structure 26 with the shopping items;

4. repeating steps (2) and (3) as needed until all of the shopping items are placed into a bag structure 26;

5. transporting the filled bag structures 26 to a desired destination;

6. removing the shopping items from each bag structure 26, and;

7. folding each bag structure 26 into a compact shape and stacking each bag structure 26 on edge inside the carrier 14 so that said size identification means is visual to a user.

If it is desirable to attach the carrier 14 to a shopping cart 95 while shopping, then the method recited above may also include step 8, carried out after between steps 1 and 2, wherein the cart attachment means attached to the carrier 14 is attached to the shopping cart 95.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. A shopping bag system, comprising:

a. a carrier having a top opening, a bottom panel, a front panel, a back panel, a right side panel, a left side panel, and a lid panel attached to said carrier which covers said a top opening;

b. a set of shopping bags including a plurality of bag structures, each said bag structure capable of being folded into a compact shape and stored on one edge inside said carrier, each said bag structure having a reinforced bottom surface, a front surface, a back surface, a right side surface, and a left side surface, said bottom surface having a transverse axis, and;

c. a size identification means printed on each said bag structure so that when said bag structure is folded and stored inside said carrier, said size identification means is visible through said top opening of said carrier, said size identification means having an identifying color capable of indicating the size of each bag structure printed thereto.

2. A shopping bag system as recited in claim 1, further including a cart attachment means attached to said carrier which enables said carrier to be selectively attached to a shopping cart.

3. A shopping bag system as recited in claim 2, wherein said cart attachment means includes a lid panel attachment means disposed between said lid panel and said back panel of said carrier, said lid panel attachment means being disposed between said lid panel and said back panel so that said lid panel may be folded over and selectively attached to said back panel to selective attach said carrier to said shopping cart.

4. A shopping bag system as recited in claim 3, wherein said size indication means comprises a band having said identifying color printed across said transverse axis of said bottom surface of each said bag structure.

5. A shopping bag system as recited in claim 3, wherein said size identification means comprises entire said bottom surface is said identifying color.

6. A shopping bag system as recited in claim 2, further including a strap attached to said carrier, said strap having a first end attached to said right side panel of said carrier and a second end attached to said left side panel of said carrier, said strap being a sufficient length so that a user of said system may carry said carrier around his shoulder during use.

7. A shopping bag system as recited in claim 6, further including a strap compartment attached to said carrier capable of storing said strap inside said carrier.

8. A shopping bag system as recited in claim 2, further including said carrier having a bag size code indicator manufactured on the outer surfaces of said front or said rear panels.

9. A shopping bag system as recited in claim 8, wherein said bag size code indicator is a plurality of colored code elements, each said code element having a color identical to one said size identification means on said bag structure stored inside said carrier.

10. A shopping bag system as recited in claim 1, further including a plurality of fold lines manufactured on each said bag structure, said fold lines comprising two horizontal fold lines and one vertical fold line, said horizontal fold lines being disposed on said bag structure to enable said bag structure to be folded into three equal, upper, middle and lower sections, said vertical fold line being disposed on said bag structure to enable said bag structure to be folded into two equal left and right sections.

11. A shopping bag system as recited in claim 10, wherein each said bag structure of said set of shopping bags is made of nylon material.

12. A shopping bag system as recited in claim 10, wherein each said bag structure of said set of shopping bags is made of fabric material.

13. A shopping bag system as recited in claim 10, wherein each said bag structure of said set of shopping bags is made of paper.

14. A shopping bag system as recited in claim 12, wherein said set of shopping bags comprise four large bag structures, three medium bag structures, and two small size bag structures.

15. A shopping bag system, comprising:

a. a carrier having a top opening, a bottom panel, a front panel, a back panel, a right side panel, a left side panel, and a lid panel which covers said a top opening;

b. a set of shopping bags including a plurality of bag structures, said bag structure capable of being folded into a compact shape and stored on one edge inside said carrier, each said bag structure having a reinforced bottom surface, a front surface, a back surface, a right side surface, and a left side surface, said bottom surface having a transverse axis, and;

c. a size identification means printed each said bag structure so that when said bag structure is folded and stored inside said carrier, said size identification means is visible through said top opening of said carrier, said size identification means having a characteristic color capable of indicating the size of each said bag structure;

d. a bag size code indicator manufactured on said front or said back panel of said carrier enabling the user of said system to identify said bag structures stored therein, and;

e. a strap attached to said carrier, said strap having a first end attached to said right side panel of said carrier and a second end attached to said left side panel of said carrier, said strap being a sufficient length so that a user of said system may carry said carrier around his shoulder during use.

16. A shopping bag system as recited in claim 15, further including a strap compartment attached to said carrier capable of storing said strap inside said carrier.

17. A shopping bag system as recited in claim 16, further including a lid panel attachment means disposed between said lid panel and said back panel of said carrier, said lid panel attachment means being disposed so that said lid panel may be folded over and selectively attached to said back panel to exposed said opening in said carrier and attached to said shopping cart.

18. A shopping bag system as recited in claim 17, further including a plurality of fold lines manufactured on each said bag structure, said fold lines comprising two horizontal fold lines and one vertical fold line, said horizontal fold lines being disposed on said bag structure to enable said bag structure to be folded into three equal, upper, middle and lower sections, said vertical fold line being disposed on said bag structure to enable said bag structure to be folded into two equal left and right sections.

19. A method of carrying shopping items, comprising the following steps:

a. selecting a carrier containing set of shopping bags, said set of shopping bags comprising a plurality of folded bag structures stacked on edge horizontally therein, each said bag structure having size identification means printed thereon which is visible when said bag structures are stacked inside said carrier, said carrier having an attached cart attachment means which enables said carrier to be selectively attached to a shopping cart when shopping;

b. selecting one said bag structure from said set of shopping bags carried inside said carrier using said size identification code printed on each said bag structure for carrying shopping items;

c. filling the selected said bag structure with said shopping items;

d. repeating steps (b) and (c) as needed until all of said shopping items are placed into said bag structures;

e. transporting said shopping items to a desired destination;

f. removing said shopping items from each said bag structure, and;

g. folding each said bag structure into a compact shape and stacking each said bag structure on edge inside said carrier so that said size identification means is visual to a user of said system.

20. A method as recited in claim 19, wherein the following step (h) is carried out after between step (a) and step (b), said step (h) comprising:

attaching said cart attachment means to a shopping cart to attach said carrier thereto.

* * * * *